US005356056A

United States Patent [19]

Teuten

[11] Patent Number: 5,356,056

[45] Date of Patent: Oct. 18, 1994

[54] ADJUSTABLE BOW MAKING DEVICE FORM

[76] Inventor: Craig Teuten, 17 Wapping Rd., Kingston, Mass. 02364

[21] Appl. No.: 93,402

[22] Filed: Jul. 19, 1993

[51] Int. Cl.[5] ..... A41H 43/00

[52] U.S. Cl. ..... 223/46; 223/44

[58] Field of Search ..... 223/44, 46, 28; 428/4

[56] References Cited

U.S. PATENT DOCUMENTS 2,542,222 2/1951 Welch ..... 223/46
3,223,440 12/1965 Rosenzweig ..... 223/46
3,501,070 3/1970 Stattuck ..... 223/46
4,454,968 6/1984 St. Lawrence ..... 223/46

*Primary Examiner*—Clifford D. Crowder
*Assistant Examiner*—Bibhu Mohanty
*Attorney, Agent, or Firm*—Lahive & Cockfield

[57] ABSTRACT

A device form made from a thermoplastic material for the making of ribbon bows. The base plate of the device has a set of rods mounted vertically. A second and separate set of rods mounted vertically in a plate (S) is moved under J-Bar to a distance from the rods in the base plate determining the size of the bow. Plate (S) is temporarily held in position by a spring-pressured bearing while the bow is formed.

8 Claims, 3 Drawing Sheets

ADJUSTABLE BOW MAKING DEVICE FORM

BACKGROUND

1. Field of the Invention

This invention relates to the making of decorative bows and a device that will assist in the making of said bows.

2. Description of Prior Art

Originally, decorative bows were made by hand. This time-consuming and tiring operation limited not only the quantity, but also the quality of the bows. Skilled operators became more proficient, but their ability to produce substantial quantity was very limited. This tiring, hand operation limited the number of bows that could be produced in a given time frame. The unskilled operator found the process of making bows by hand difficult, if not impossible, to master with any degree of quality and quantity.

Various attempts have been made to assist bow makers, from long nails protruding from a wooden board to a crude device made of metal with metal prongs. Thereafter, inventors created devices and forms that would make or assist in creating bows from ribbon. These inventions fell into two distinct categories. The first category consists of large, complicated, expensive commercial machines, such as U.S. Pat. No. 4,449,652 Coppins, that are out of the reach of the average business or individual who wants bows for the completion of their projects. The second category consists of small and inexpensive devices and forms, such as U.S. Pat. No. 3,229,870 Capstick or U.S. Pat No. 4,651,908 Ford, that limits the creativity and applications of the operator. These inventions make only one size and one type of bow. There is very little, if any, versatility to these inventions.

Contrary to the above mentioned inventions, my invention is extremely versatile. The size of the bow is adjustable by increments of one inch. The number of loops in the bow is determined by the operator and can vary from a minimum of two to thirty, forty or even more, if the operator desires. The width of the ribbon is not predetermined for the operator. The operator can select from narrow to very wide ribbon. Ribbon is precut only after the operator determines the number of loops and the size (diameter) of the bow desired. In addition to this invention's versatility, it is relatively inexpensive and affordable to all professional florists and similar business people who use bows in their products.

DESCRIPTION OF INVENTION

Figure 1:
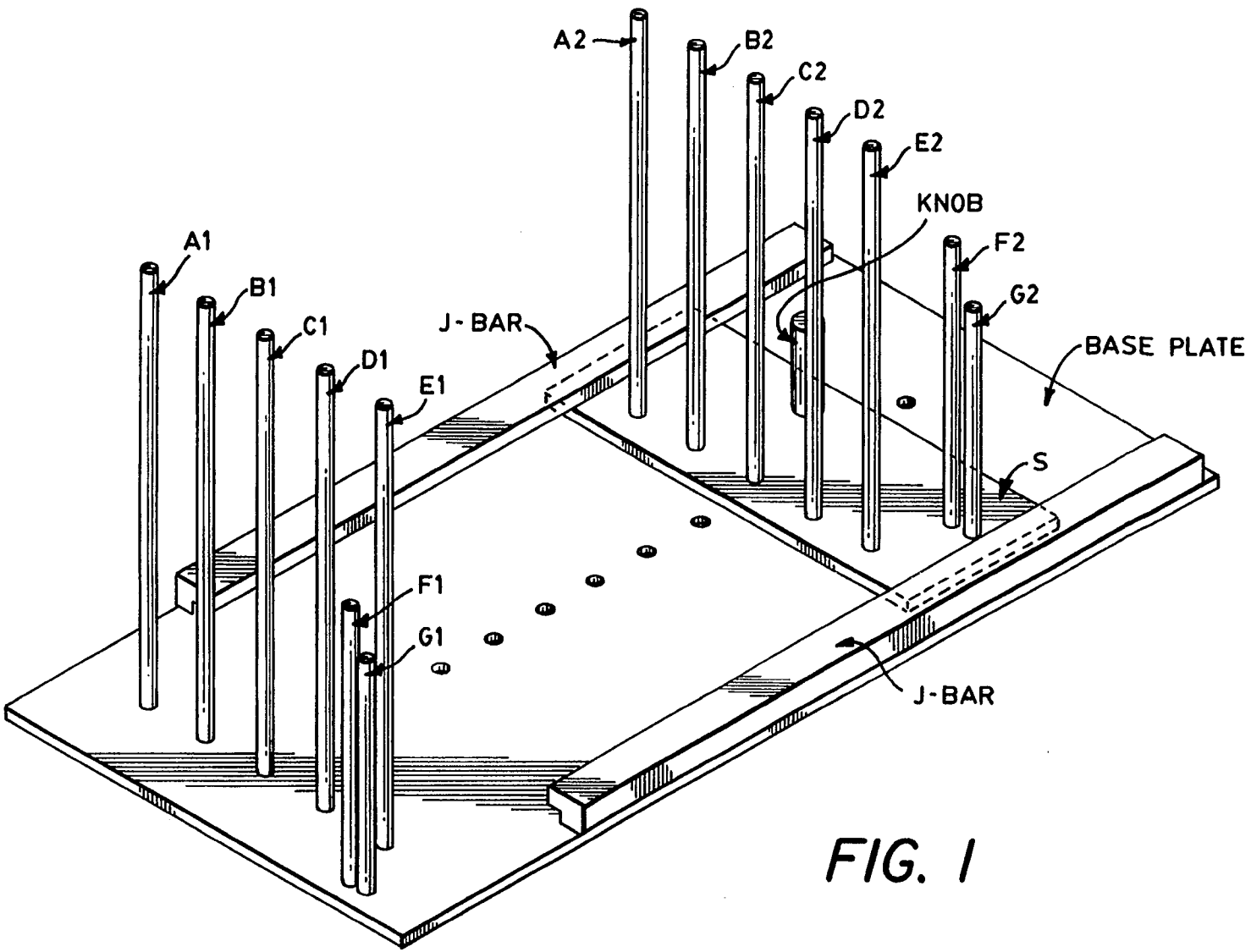
FIG. 1 is a perspective view of the adjustable bow making device.
Figure 3:
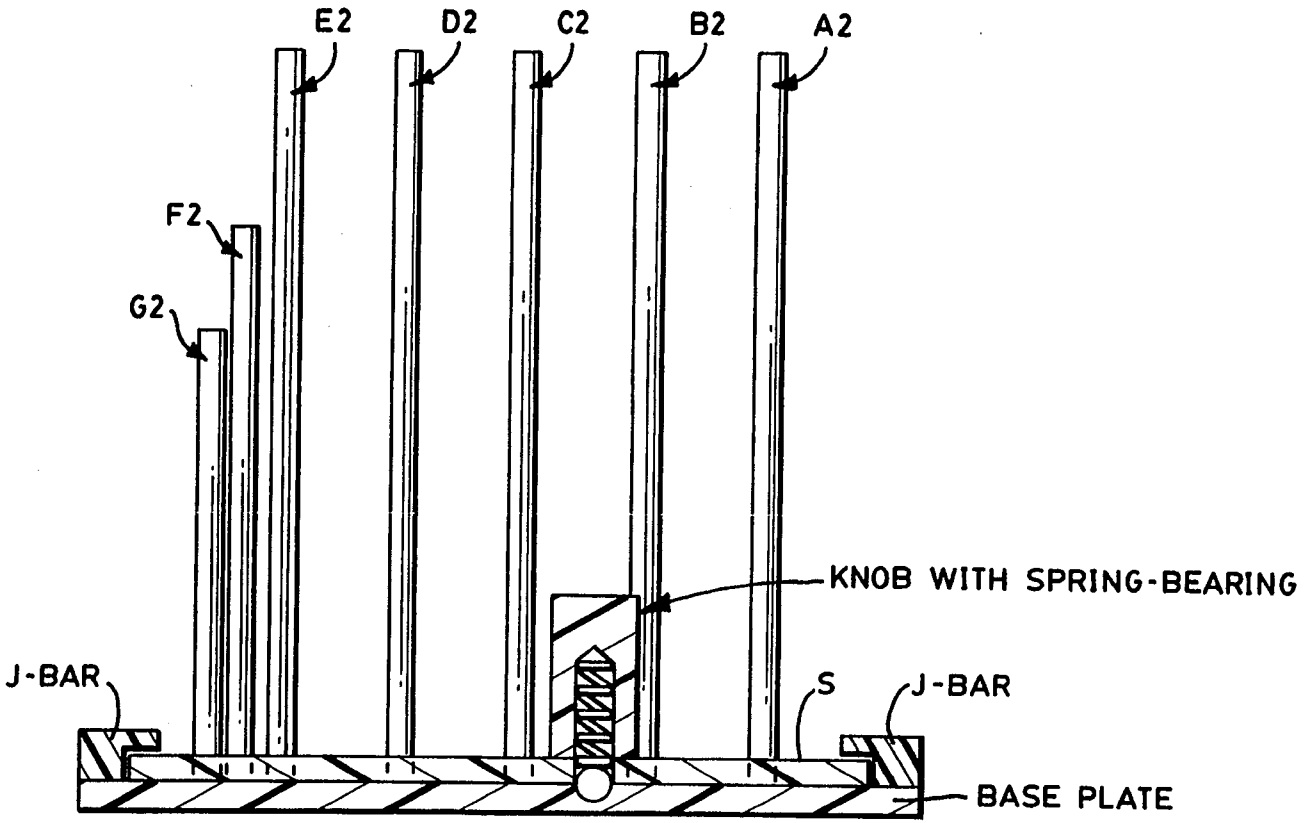
FIG. 3 is a section showing the ball and spring device on the sliding plate.

A device (shown in FIG. 1) consisting of two sets of rods mounted vertically and separately, opposing each other equidistant, in the same horizontal plane. The device, with exception of spring and ball bearing, is made of polycarbonate, a thermoplastic of high tensile strength. One set of rods is fixed in a base plate at the left end of said plate. The second set of rods is mounted in a smaller plate called the slide plate (S) and that plate is allowed to move on the surface of the base plate. The slide plate is mounted under J-Bar to permit movement in the horizontal plane opposing the rods in the base plate. The rods in each plate oppose each other in equal distance as the slide plate is moved on the base plate. The slide plate is held in a temporary fixed position on the base plate by spring-pressured bearing as shown in FIG. 3. The bearing and spring are concealed in a shaft mounted on the slide plate. A series of counter-sunk holes in the base plate receive the bearing to hold the slide plate in position as the bow is formed.

OPERATION

Before the operator begins to use this device, he or she makes certain decisions, including the size (diameter) and the number of loops in their bow. For illustration purpose, I will describe, hereafter, creating a bow with ten loops and being eight inches in diameter.

First, the slide plate (s) is moved to a position where the two sets of vertical rods are at a distance of eight inches from each other. After selecting the ribbon of choice, the operator cuts off a length of three yards for the proposed said bow.

Figure 2:
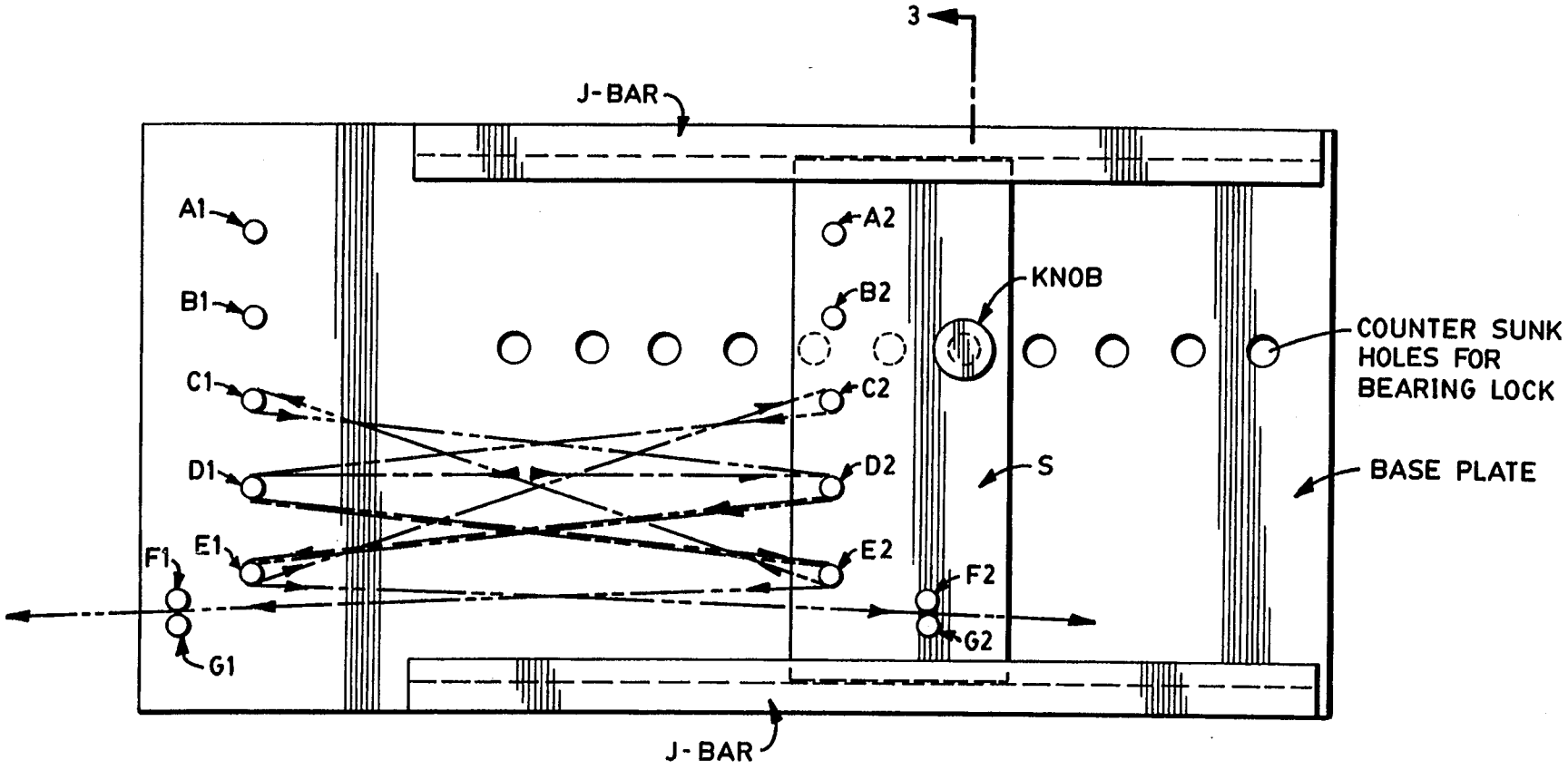
FIG. 2 is an overhead view with illustration of a typical weaving pattern.

With equal length of ribbon in each hand and the distance of ribbon between the hands a maximum of twelve inches, loop the ribbon over rod D1 and D2 respectively with the backside of the ribbon against the rod. Proceed by holding the ribbon with the backside of the ribbon facing up toward the operator and the lengths of ribbon extending between the two sets of rods. Cross ribbon over itself creating the letter X. FIG. 2. Continuing to hold the backside of the ribbon facing up, loop each length over E1 and E2 respectively, again the backside of the ribbon should be in contact with the rod. Allow the lengths of ribbon to extend from the rods in the operators hands with backside of ribbon facing up. Cross lengths in above mentioned letter X fashion and loop each length of ribbon over rods C1 and C2 respectively. With lengths of ribbon extending between sets of rods in operators hands, with backside of ribbon facing up, cross again in above mention letter X fashion. Loop lengths over rods D1 and D2 respectively. Again, with ribbon lengths extending between sets of rods, backside of ribbon facing up, cross in above mention letter X fashion. Loop over rods E1 and E2 respectively. With lengths of ribbon extending toward operator and between F1/G1 and F2/G2 backside of ribbon facing up cross ribbon as in above mentioned letter X fashion. Place the lengths of ribbon between F1/G1 and F2/G2 respective. This will hold the ribbon in place and prevent unwinding from the rods.

At this time, to secure ribbon in bow form, a length of floral wire, ribbon, string or other method is wrapped around the ribbon at the mid point between the two sets of rods and synched as tight as possible. This syncing will pull the lengths of ribbon together and allow the bow to be lifted vertically off the rods. When off the rods, the operator again tightens the wire or other method used as tight as possible and the decorative bow is complete.

Thus, as the reader can see, this bow device has distinct advantages. It allows the professional or amateur the ability to make what would be complicated and difficult to make by hand. It makes available to the public, at relatively low cost, a device that will make production of quality bows a simple operation. The technique for using this machine is easily learn after reading simple instructions or being shown how the device operates.

I claim:

1. A floral bow making apparatus comprising, a base plate having first and second oppositely positioned edges, a first array of upstanding rod elements fixed to said plate member near one edge thereof in spaced apart positions extending generally parallel to said first edge thereof, a slide plate positioned on said base plate near said second edge and arranged to slide back and forth along said base plate in a direction toward and away from said first array of upstanding rod elements, a second array of upstanding rod elements fixed to said slide plate in a spaced positions generally parallel to said first array of upstanding rod elements, and detent means in said base plate for providing a series of temporarily fixed discrete positions of said sliding plate along said base plate.

2. Apparatus in accordance with claim 1 wherein said slide plate is temporarily held in a discrete position and is releasable upon application of pressure to it in a direction toward or away from said first array of upstanding rod members.

3. Apparatus in accordance with claim 2 wherein said detent means includes a series of recesses in the surface of said base plate corresponding to said discrete positions and a spring loaded element carried by said slide plate for cooperation with said recesses to provide pressure releasable discrete positions for said slide plate.

4. Apparatus in accordance with claim 2 further including guide rails on said base plate along side edges generally perpendicular to said first array of upstanding rod members thereby guiding said slide plate for movement restricted to a direction parallel to said side edges.

5. Apparatus in accordance with claim 1, wherein said plate member is made of rigid polycarbonate.

6. Apparatus in accordance with claim 3 wherein said spring loaded element is a ball retained on said slide plate with an opening permitting said ball to be spring pressured into said recesses.

7. Apparatus in accordance with claim 2 wherein said upstanding rod members have a limited degree of flex.

8. Apparatus in accordance with claim 1 and further including a first additional pair of closely spaced upstanding rod elements positioned between said first array of rod elements and said first edge of said plate member and a second pair of closely spaced upstanding rod elements positioned between said second array of upstanding rod elements and said opposing edge of said plate member.

* * * * *